US009752451B2

(12) United States Patent
Blaney et al.

(10) Patent No.: US 9,752,451 B2
(45) Date of Patent: Sep. 5, 2017

(54) ACTIVE CLEARANCE CONTROL SYSTEM WITH ZONE CONTROLS

(71) Applicant: UNITED TECHNOLOGIES CORPORATION, Farmington, CT (US)

(72) Inventors: Ken F. Blaney, Middleton, NH (US); Paul M. Lutjen, Kennebunkport, ME (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 1227 days.

(21) Appl. No.: 13/719,584

(22) Filed: Dec. 19, 2012

(65) Prior Publication Data

US 2014/0248115 A1 Sep. 4, 2014

(51) Int. Cl.
*F01D 25/12* (2006.01)
*F01D 11/24* (2006.01)

(52) U.S. Cl.
CPC ..... *F01D 11/24* (2013.01)

(58) Field of Classification Search
CPC ..... F01D 11/24
USPC ..... 415/115, 116, 173.2, 173.1, 177, 178
See application file for complete search history.

(56) References Cited

U.S. PATENT DOCUMENTS 4,337,016 A 6/1982 Chaplin
5,100,291 A * 3/1992 Glover ..... F01D 11/24 165/169
5,281,085 A * 1/1994 Lenahan ..... F01D 11/24 415/116
5,385,013 A 1/1995 Barron et al.
6,048,171 A * 4/2000 Donnelly ..... F01D 17/105 137/601.05
6,666,645 B1 * 12/2003 Arilla ..... F01D 11/24 415/116
7,503,179 B2 * 3/2009 Estridge ..... F01D 11/24 415/108
7,704,039 B1 4/2010 Liang
2009/0288390 A1 * 11/2009 Pavia ..... F02K 9/972 60/267
2010/0034635 A1 * 2/2010 Erickson ..... F01D 11/24 415/1

(Continued)

OTHER PUBLICATIONS

International Search Report and Written Opinion for related International Application No. PCT/US13/68672; report dated Jul. 28, 2014.

*Primary Examiner* — Woody Lee, Jr.
(74) *Attorney, Agent, or Firm* — Cantor Colburn LLP

(57) ABSTRACT

An ACC system and method of using such for changing a turbine blade to BOAS gap on an aircraft engine is disclosed. The ACC system may comprise a first ring, a first supply line and a first flow control assembly. The first ring may be configured to substantially encircle a portion of a case assembly that is disposed around an aircraft engine turbine. The first ring may include a plurality of segments that each define a chamber, an inlet port and a plurality of outlet ports. At least a portion of the outlet ports may be configured to be disposed adjacent to the case. The first supply line may be operatively connected to a first segment of the plurality of segments. The first flow control assembly may be operatively connected to the first supply line and configured to meter the flow of cool air into the first segment.

15 Claims, 4 Drawing Sheets

(56) References Cited

U.S. PATENT DOCUMENTS

2011/0229306 A1 9/2011 Lewis et al.

* cited by examiner

ACTIVE CLEARANCE CONTROL SYSTEM WITH ZONE CONTROLS

TECHNICAL FIELD

This disclosure relates to clearance control assemblies for aircraft engines, and more particularly to clearance control assemblies for cooling of the portion of the case assembly surrounding the turbine section of an aircraft engine.

BACKGROUND

For aircraft utilizing turbine engines, a case assembly typically encloses the turbine. Internal to the case assembly, the space surrounding the turbine blades ("the envelope") may initially be generally circular in cross-section and dimensioned to provide a relatively small gap between the Blade Outer Air Seals (BOAS) that line the envelope of the case assembly and the tip of each rotating turbine blade.

After the engine experiences a break-in period, including some amount of flight time, the gap between the BOAS and the tip of each turbine blade may no longer be consistent due to a variety of reasons. In some portions of the envelope the gap may be greater than in other portions of the envelope. Furthermore, some changes in the gap between the BOAS and the tips of the turbine blades may occur during the various phases of flight due to expansion of the case assembly that surrounds the turbine. Larger than necessary gaps between the BOAS and the tips of the turbine blades may decrease the efficiency of the turbine.

SUMMARY OF THE DISCLOSURE

In an aspect, an active clearance control (ACC) system is disclosed. The ACC system may comprise a first ring, a first supply line and a first flow control assembly. The first ring may be configured to substantially encircle a portion of an outer surface of a case assembly that is disposed around a turbine in an aircraft engine. The first ring may include a plurality of segments. Each segment may define a chamber, an inlet port and a plurality of outlet ports. In an embodiment, at least a first portion of the outlet ports may be configured to be disposed adjacent to the outer surface of the case assembly. The first supply line may be operatively connected to a first segment of the plurality of segments. The first flow control assembly may be operatively connected to the first supply line and configured to meter the flow of cool air into the first segment.

In an embodiment, the first ring may be tube-shaped. In a refinement, the case assembly may include a rail projecting from the outer surface. A second portion of the outlet ports may be configured to be disposed adjacent to the rail.

In another embodiment, the first ring may be blanket-shaped.

In another embodiment, the first ring may be rotatable around the case assembly.

The ACC system may also include a cool air source connected to the first supply line and configured to supply cool air to the first supply line.

In another embodiment, the ACC system may also include a plurality of supply lines. The first supply line may be one of the plurality of supply lines, and each supply line may be connected in a one-to-one correspondence to one of the plurality of segments. The ACC system may further comprise a plurality of flow control assemblies. The first flow control assembly may be one of the plurality of flow control assemblies and each flow control assembly may be connected in a one-to-one correspondence to one of the plurality of supply lines.

In yet another embodiment, the first flow control assembly may be a metering plate configured to control the amount of cool air that flows to the first segment.

In another aspect, an ACC system is disclosed. The ACC system may comprise a first ring configured to substantially encircle a portion of an outer surface of a case assembly that is disposed around a turbine of an aircraft engine, a second ring concentrically nested around the first ring, a supply line and a plurality of flow control assemblies. The first ring may include a plurality of segments. Each segment may define a chamber, an inlet port and a plurality of outlet ports. In an embodiment, at least a first portion of the outlet ports of the first ring may be configured to be disposed adjacent to the portion of the outer surface of the case assembly disposed around the turbine. The second ring may define a flow path from the supply line to each of the plurality of segments. The supply line may be operatively connected to the second ring. Each flow control assembly may be disposed between the second ring and the segments of the first ring. The plurality of flow control assemblies and the plurality of segments may be disposed in a one-to-one correspondence. Each flow control assembly may be configured to meter the flow of cool air from the second ring into the respective segment of the first ring.

In an embodiment, the combination of the first and second rings may be generally tube-shaped.

In another embodiment, the case assembly may include a rail projecting from the outer surface, and a second portion of the outlet ports may be configured to be disposed adjacent to the rail. In a refinement, the combination of the first and second rings may be generally blanket-shaped.

In another embodiment of the ACC system, the first and second rings may be rotatable.

In another embodiment, the ACC system may include a cool air source connected to the supply line and configured to supply cool air to the supply line.

A method is also disclosed for changing a gap between a turbine blade of a turbine disposed in an aircraft engine and a Blade Outer Air Seal (BOAS) disposed proximal to the turbine blade. The method may comprise determining the gap between the turbine blade and the BOAS, and based on the result of the determining step, adjusting an ACC system to change the amount of cool air impinging upon an outer surface of a case assembly disposed around the turbine. The ACC system may comprise a first ring including a plurality of segments substantially encircling the outer surface of the case assembly, a first supply line operatively connected to a cool air source and a first segment of the plurality of segments, and a first flow control assembly operatively connected to the first supply line and configured to meter the flow of cool air into the first segment. Each segment may define a chamber and a plurality of outlet ports. The cool air flows through the plurality of outlet ports onto the outer surface of the case assembly.

The method may further comprise rotating the first ring around the case assembly to adjust the amount of cool air impinging on the outer surface of the case assembly.

In another embodiment, the method may further comprise receiving cool air from a second ring disposed radially outward from the first ring, the second ring defining a flow passage between the first supply line and the first segment.

In a refinement, the first ring may be tube-shaped.

In another embodiment, the first ring may be configured to follow the contour of a portion of the outer surface of the case assembly and a rail projecting from the outer surface.

DETAILED DESCRIPTION

Figure 1:
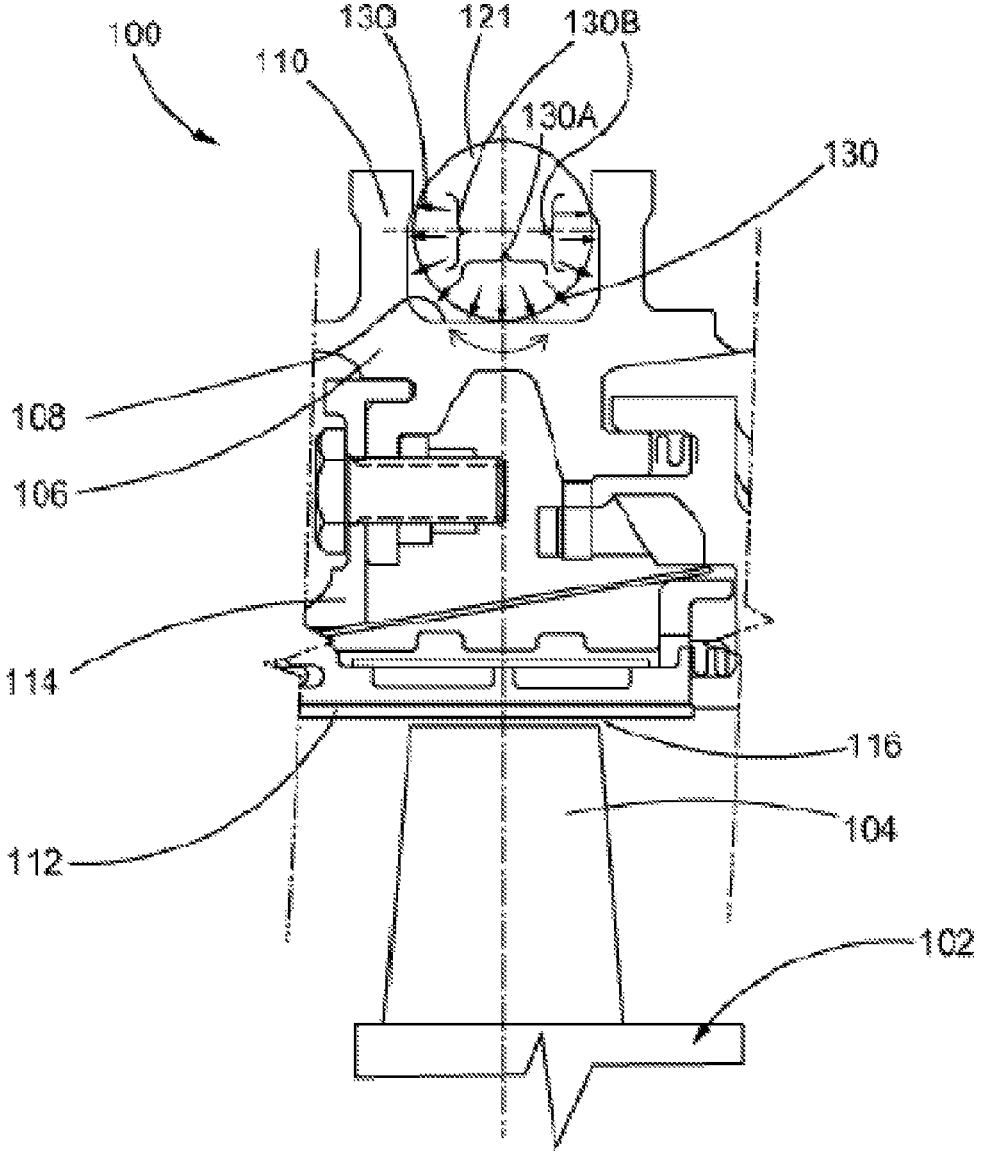
FIG. 1 is a cross-sectional view of a portion of a case assembly enclosing a turbine in an aircraft engine.

FIG. 1 illustrates a cross sectional view of a portion of a case assembly enclosing a portion of an aircraft engine 100. The engine 100 includes a turbine 102 having a plurality of turbine blades 104. The case assembly 106 is disposed around the circumference of the turbine 102 (and its turbine blades 104). The case assembly 106 may comprise an outer surface 108, one or more rails 110 projecting in a generally radial direction outward from the outer surface 108, one or more BOAS 112 and one or more BOAS support(s) 114. Each BOAS 112 may be disposed proximal to the turbine blades 104 and collectively form the outer wall of the turbine 102 of the engine 100. Between the tip of the turbine blade and each BOAS there is a gap 116.

Figure 2:
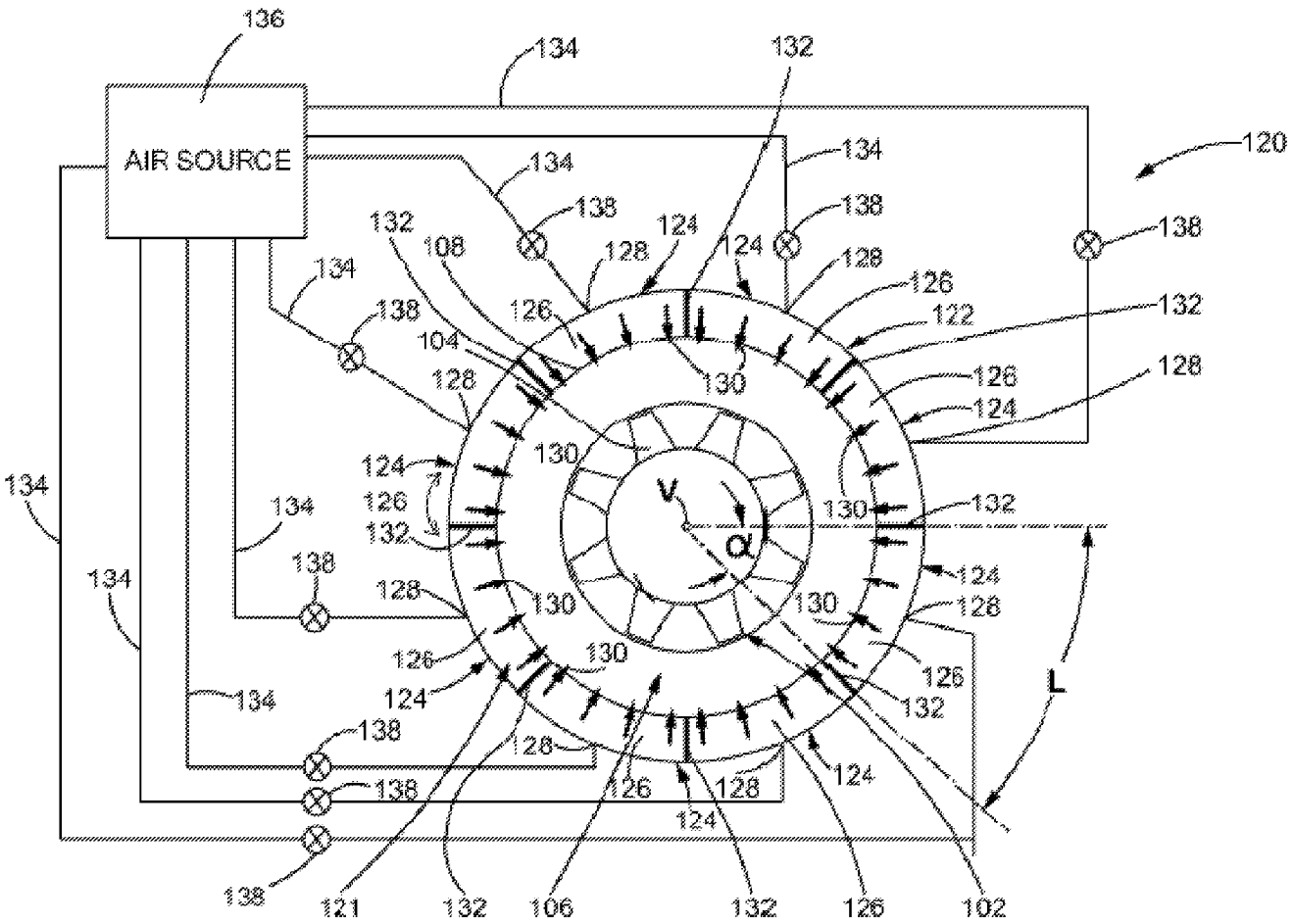
FIG. 2 is a schematic of an ACC system constructed in accordance with the teachings of this disclosure.

An ACC system 120 may be disposed on the outside of the case assembly 106. FIG. 2 illustrates one embodiment of the ACC system 120. The ACC system may include a cooling ring 121, one or more supply lines 134 and one or more flow control assemblies 138.

The cooling ring 121 may be configured to substantially encircle the circumference of the case assembly 106, or more specifically the outer surface 108 of the case assembly 106 that is disposed around the turbine 102 of the aircraft engine 100. In one embodiment, the cooling ring 121 may comprise a first ring 122. The first ring 122 may include a plurality of segments 124. Each segment 124 may form a portion of the circumference of the first ring 122.

In one embodiment, the arc length L of the angle $\alpha$ formed by each segment 124 may be generally equal. The vertex V of the angle $\alpha$ may be centered on axis of rotation for the turbine blades. For example, in the embodiment illustrated in FIG. 2, there are eight segments 124. Each segment 124 forms an angle $\alpha$ of about 45°. The arc lengths L of the segments 124 are generally equal. In other embodiments, the quantity of segments 124 (and the arc length L and the angle $\alpha$) may vary. In yet another embodiment, the arc length L of each segment 124 may vary such that the arc lengths L of the segments 124 are not equal.

Each segment 124 may define a chamber 126. Each segment 124 may also define an inlet port 128 and a plurality of outlet ports 130. At either end of each segment there may be a bulkhead 132 that separates the segment's chamber 126 from the neighboring segment's chamber 126.

In one embodiment, the cooling ring 121 may be tube-shaped. Such a tube-shaped cooling ring 121 typically may have a cross section that is generally round, oval, square or rectangular, or the like. However, the term "tube-shaped" may also encompass a generally triangular shape and the like. In FIG. 1, a tube-shaped cooling ring 121 is illustrated as disposed on the case assembly 106. In other embodiments, the cooling ring 121 may be generally blanket-shaped and include a bottom surface 133 that generally follows the contours of the outer surface 108 of the case assembly 106, or of the outer surface 108 and the rail(s) 110. Such a blanket-shaped embodiment is illustrated, in part, in FIG. 3.

Figure 3:
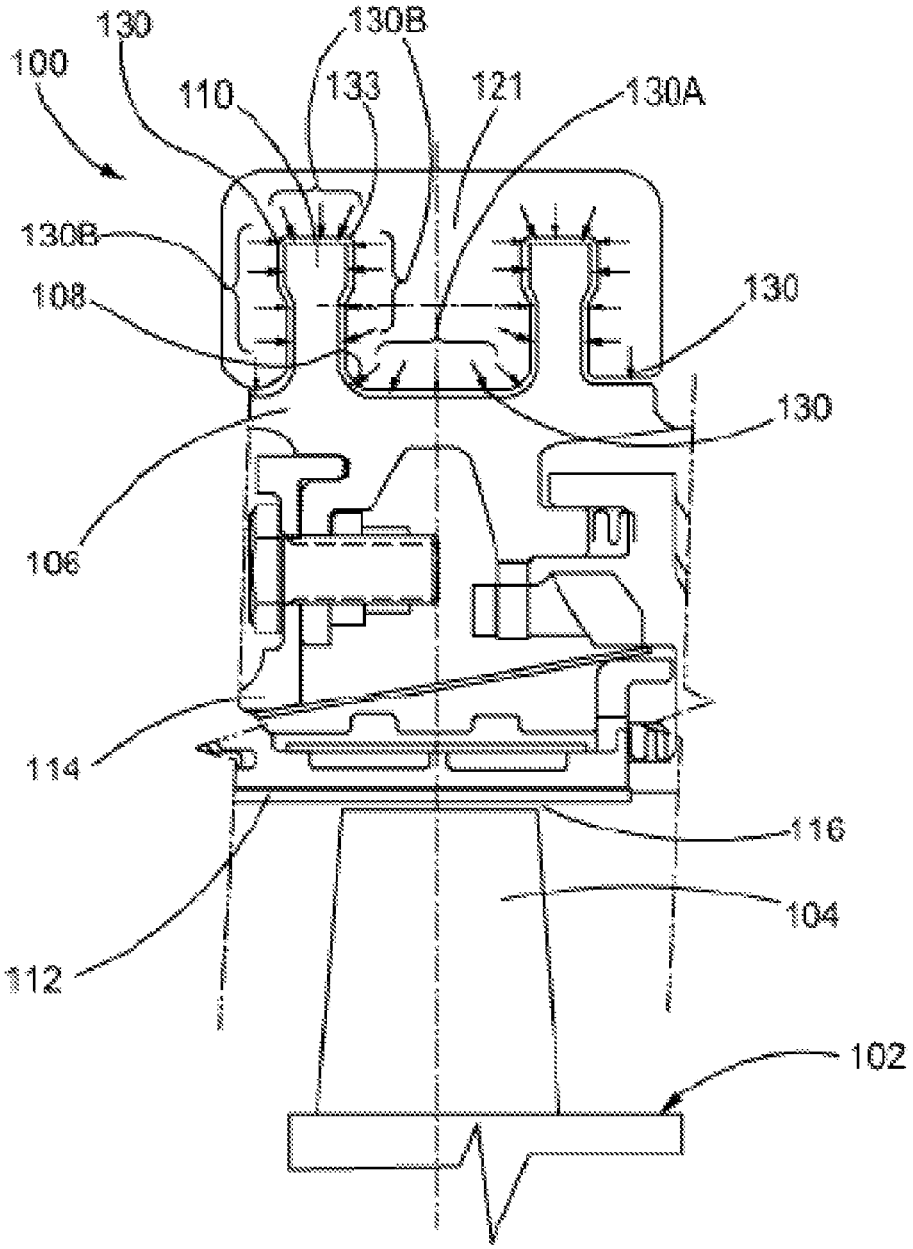
FIG. 3 is another cross-sectional view of a portion of a case assembly enclosing a turbine in an aircraft engine.

As shown in FIGS. 1 and 3, a first portion of the outlet ports 130A may be configured to be disposed adjacent to the outer surface 108 of the case assembly 106. A second portion of the outlet ports 130B may be configured to be disposed adjacent to the rail(s) 110 of the case assembly 106. In one embodiment, the cooling ring 121 may be configured to be rotatable around the case assembly 106.

Referring now to FIG. 2, the supply line(s) 134 may be operatively connected to a segment 124 of the first ring 122 and to a cool air source 136. The cool air source 136, such as those known in the art, may be configured to supply cool air to the supply line(s) 134. In one embodiment illustrated in FIG. 2, there may be a plurality of supply lines 134. As shown in FIG. 2, the supply lines 134 may configured in a one-to-one correspondence with the segments 124 of the first ring 122.

The flow control assembly 138 may be operatively connected to the supply line 134. In the exemplary embodiment of FIG. 2, there is one flow control assembly 138 for each supply line 134. The flow control assembly 138 is configured to meter the flow of cool air from the cool air source 136 into a segment 124 chamber 126. In one embodiment, the flow control assembly 138 may be a metering plate, such as those known in the art, that is configured to control the amount of cool air that flows from a supply line 134 to a segment 124.

Figure 4:
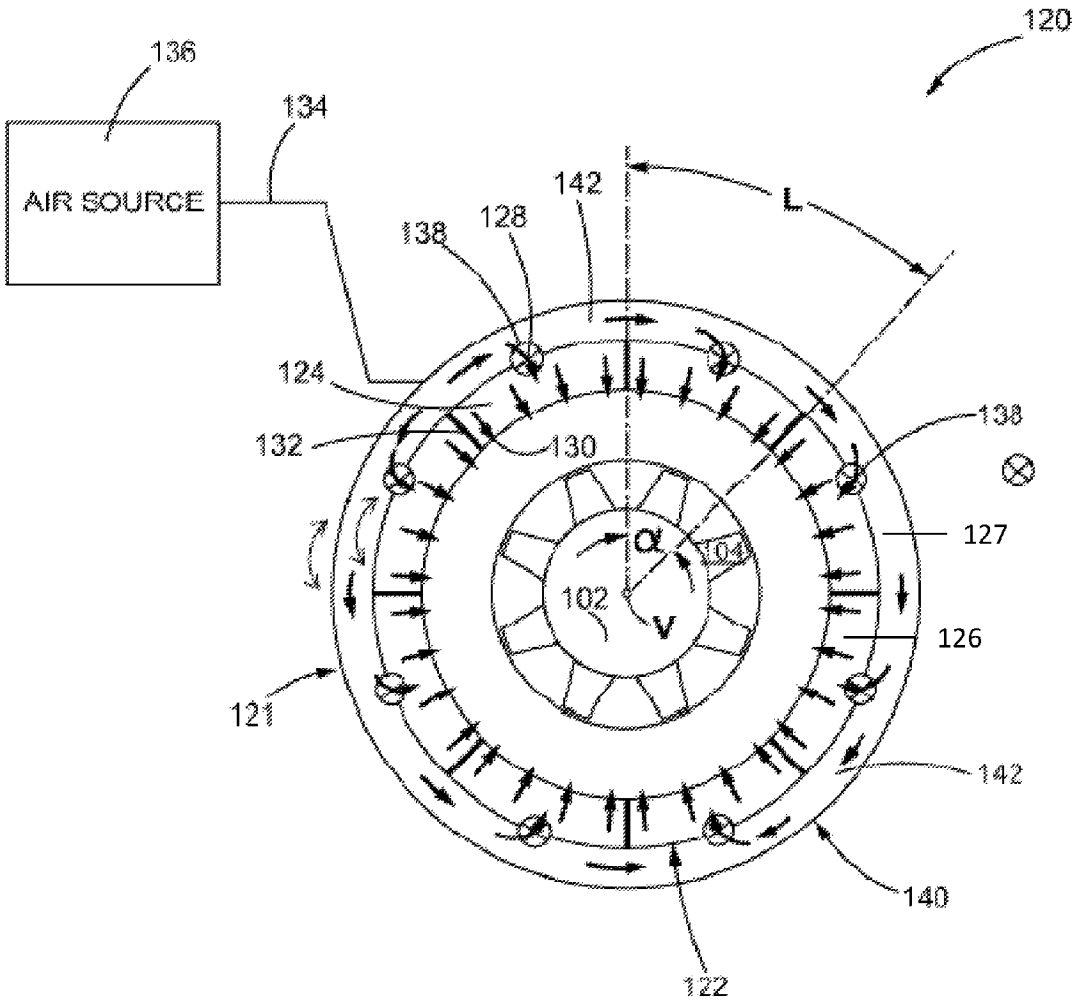
FIG. 4 is a schematic of another ACC system constructed in accordance with the teachings of this disclosure.

FIG. 4 illustrates another embodiment of the ACC system 120. In this embodiment, the ACC system 120 may comprise a cooling ring 121, a supply line 134, and a plurality of flow control assemblies 138. The cooling ring 121 may include a first ring 122 and a second ring 140. Similar to the embodiment illustrated in FIG. 2, the first ring 122 may be configured to substantially encircle a portion of the outer surface 108 of the case assembly 106 that is disposed around a turbine 102 of an aircraft engine 100. The first ring 122 includes a plurality of segments 124 such as those described earlier with reference to FIG. 2.

The second ring 140 of the embodiment shown in FIG. 4 may be concentrically nested around the first ring 122. The second ring 140 defines an outer chamber 127. The outer chamber 127 is disposed between an outer surface of the first ring 122 and an inner surface of the second ring 140. The outer chamber 127 is disposed radially outward of the chamber 126 and is separated from the chamber 126 by the outer surface of the first ring 122. The outer chamber 127 is fluidly connected to the chamber 126 through the flow control assembly 138 and the inlet port 128. A flow path 142 is established within the chamber 126 to enable fluid flow from the supply line 134 through the second ring 140, through the flow control assembly 138, and through the inlet port 128 to each of the plurality of segments 124 of the first ring 122. The fluid flow flows through the first ring 122 and through the outlet port 130 and onto the rail(s) 110. The supply line 134 may be operatively connected to the second ring 140 and to the cool air source 136.

Each of the plurality of flow control assemblies 138 may be disposed between the second ring 140 and the segments 124 of the first ring 122. The flow control assemblies 138 and the segments 124 may be in a one-to-one correspondence. Each flow control assembly 138 may be configured to meter the flow of cool air from the second ring 140 into the respective segment of the first ring 122. Also, like the embodiment illustrated in FIG. 2, the flow control assemblies 138 may be metering plates, valves or the like that control the amount of cool air that flows into the segments 124.

The combination of the first and second rings 122, 140 may be generally tube-shaped, or may be generally blanket-shaped. Also, in one embodiment, the combination of the first and second rings 122, 140 may be rotatable around the case assembly 106. In another embodiment, the first ring may be rotatable while the second ring may be stationary, and vice versa.

INDUSTRIAL APPLICABILITY

In general, cool air flows from the cool air source 136 through a supply line 134 to a segment 124 of the first ring 122. In the first embodiment illustrated in FIG. 2, the cool air flows from one or more cool air sources 136 through the supply lines 134 through the inlet ports 128 in the first ring segments 124 and into the chambers 126 within the segments 124. Each segment becomes a cooling zone. There is a flow control assembly 138 on each supply line 134 that controls the amount of cool air allowed to flow from the supply line 134 into the chamber 126 of the first ring segment 124 to which the supply line 134 is connected.

In the second embodiment illustrated in FIG. 4, the cool air flows from one or more cool air sources 136 through the supply line 134 to the second ring 140. Once in the second ring 140, the cool air moves along the flow path 142 defined by the second ring 140. There is a flow control assembly 138 between the second ring 140 and each segment 124 of the first ring 122. Each flow control assembly 138 controls the amount of cool air allowed to flow from the second ring 140 (and indirectly the supply line 134) into the chamber 126 of (its respective) first ring segment 124.

Once in the chamber 126, the cool air flows out of the outlet ports 130 in each segment 124 and impinges on the outer surface 108 of the case assembly 106 or the outer surface 108 of the case assembly 106 and the rail(s) 110. The impinging cool air cools the outer surface 108 or outer surface 108 and rail(s) 110. The cooling air causes contraction of the outer surface 108 and rails 110 thereby shrinking the circumference of the case assembly 106 around the turbine blades 104. This contraction, or shrinkage, reduces the gap 116 between the turbine blade(s) and the BOAS(s). Reducing the gap 116 size in this way increases the efficiency of the turbine.

A method is disclosed for changing the gap 116 between the turbine blade 104 of a turbine 102 disposed in an aircraft engine 100 and a BOAS 112 disposed proximal to the turbine blade 104. The method may comprise determining the gap 116 between the turbine blade 104 and the BOAS 112, and based on the result of the determining step, adjusting an ACC system 120 to change the amount of cool air impinging upon the outer surface 108 of the case assembly 106 disposed around the turbine 102. In an embodiment, using an ACC system 120 like that illustrated in FIG. 4, the method may further comprise receiving cool air from a second ring 140 disposed radially outward from the first ring 122.

In another embodiment, the adjusting step may include replacing a flow control assembly 138 with a different flow control assembly 138, the different flow control assembly 138 configured to allow a different amount of cool air to flow from the supply line 134 (or second ring 140) into the chamber 126 of the first ring segment 124.

In some situations, the case assembly 106 may have expanded unequally due to loading forces. This unequal expansion may result in an out-of-round condition during the cruise portion of flight. Thus in some embodiments, the amount of cool air allowed to flow into each segment 124 may be different. In one embodiment the method may further include rotating the first ring 122 around the case assembly 106 to adjust the amount of cool air impinging on the outer surface 108 of the case assembly 106.

What is claimed is:

1. An ACC system comprising:

a first ring configured to substantially encircle a portion of an outer surface of a case assembly that is disposed around a turbine in an aircraft engine, the first ring is completely disposed within a pair of rails that radially project outwardly from the outer surface, the first ring including a plurality of segments that directly abut each other and are separated from each other by a bulkhead, each segment defining a chamber, an inlet port and a plurality of outlet ports;

a first supply line operatively connected to a first segment of the plurality of segments; and a first flow control assembly operatively connected to the first supply line and configured to meter the flow of cool air into the first segment, wherein a first portion of the outlet ports are disposed adjacent to the outer surface of the case assembly and a second portion of the outlet ports are disposed adjacent to the rails.

2. The ACC system of claim 1, wherein the first ring is tube-shaped.

3. The ACC system of claim 1, further including a cool air source connected to the first supply line and configured to supply cool air to the first supply line.

4. The ACC system of claim 1, further comprising a plurality of supply lines, the first supply line one of the plurality of supply lines, each supply line connected in a one-to-one correspondence to one of the plurality of segments.

5. The ACC system of claim 4, further comprising a plurality of flow control assemblies, the first flow control assembly one of the plurality of flow control assemblies, each flow control assembly connected in a one-to-one correspondence to one of the plurality of supply lines.

6. The ACC system of claim 1, wherein the first flow control assembly is a metering plate configured to control the amount of cool air that flows to the first segment.

7. An ACC system comprising:

a first ring configured to substantially encircle a portion of an outer surface of a case assembly that is disposed around a turbine of an aircraft engine, the first ring including a plurality of segments that directly abut each other and are separated from each other by a bulkhead, each segment defining a chamber, an inlet port and a plurality of outlet ports;

a second ring concentrically nested around the first ring, the second ring defining an outer chamber and a flow path from the supply line to each of the plurality of segments;

a supply line operatively connected to the second ring; and a plurality of flow control assemblies, each flow control assembly disposed between the second ring and the segments of the first ring, the outer chamber is fluidly connected to the chamber through the plurality of flow control assemblies, the plurality of flow control assemblies and the plurality of segments disposed in a one-to-one correspondence, each flow control assembly configured to meter the flow of cool air from the second ring into the respective segment of the first ring, wherein at least a first portion of the outlet ports of the first ring are configured to be disposed adjacent to the portion of the outer surface of the case assembly disposed around the turbine.

8. The ACC system of claim 7, wherein the first and second rings are generally tube-shaped.

9. The ACC system of claim 7, in which the case assembly includes a rail projecting from the outer surface, wherein a second portion of the outlet ports are configured to be disposed adjacent to the rail.

10. The ACC system of claim 9, wherein the first and second rings are generally blanket-shaped.

11. The ACC system of claim 7, further including a cool air source connected to the supply line and configured to supply cool air to the supply line.

12. A method for changing a gap between a turbine blade of a turbine disposed in an aircraft engine and a BOAS disposed proximal to the turbine blade, the method comprising:

determining the gap between the turbine blade and the BOAS; adjusting an ACC system to change the amount of cool air impinging upon an outer surface of a case assembly disposed around the turbine, based on the result of the determining step, the ACC system comprising a first ring including a plurality of segments that directly abut each other and are separated from each other by a bulkhead substantially encircling the outer surface of the case assembly, each segment defining a chamber and a plurality of outlet ports, a first supply line operatively connected to a cool air source and a first segment of the plurality of segments, and a first flow control assembly operatively connected to the first supply line and configured to meter the flow of cool air into the first segment, wherein the cool air flows through the plurality of outlet ports onto the outer surface of the case assembly.

13. The method of claim 12, further comprising receiving cool air from a second ring disposed radially outward from the first ring, the second ring defining a flow passage between the first supply line and the first segment.

14. The method of claim 12, wherein the first ring is tube-shaped.

15. The method of claim 12, wherein the first ring is configured to follow the contour of a portion of the outer surface of the case assembly and a rail projecting from the outer surface.

* * * * *